US007479093B1

(12) United States Patent
Immordino et al.

(10) Patent No.: US 7,479,093 B1
(45) Date of Patent: Jan. 20, 2009

(54) EXERCISE APPARATUS WITH BIOMECHANICAL ARM MOTION

(75) Inventors: Joseph Immordino, Hoffman Estates, IL (US); Eric C. White, Elgin, IL (US); Thomas J. Danowski, Schaumburg, IL (US); Marcos D. Roimicher, Lombard, IL (US)

(73) Assignee: Brunswick Corporation, Lake Forest, IL (US)

( * ) Notice: Subject to any disclaimer, the term of this patent is extended or adjusted under 35 U.S.C. 154(b) by 379 days.

(21) Appl. No.: 11/357,527

(22) Filed: Feb. 17, 2006

(51) Int. Cl.
*A63B 22/02* (2006.01)
*A63B 22/12* (2006.01)

(52) U.S. Cl. ..... 482/52; 482/57; 482/62

(58) Field of Classification Search ..... 482/51–53, 482/57, 62, 94–100
See application file for complete search history.

(56) References Cited

U.S. PATENT DOCUMENTS

| | | | | |
|---|---|---|---|---|
| 6,203,474 | B1 | 3/2001 | Jones | |
| 6,533,709 | B1 * | 3/2003 | Jones | 482/97 |
| 6,579,213 | B1 * | 6/2003 | Webber et al. | 482/100 |
| 6,656,092 | B1 | 12/2003 | Fulks | |
| 6,746,385 | B1 | 6/2004 | Habing | |
| 6,921,356 | B1 | 7/2005 | Habing et al. | |
| 6,988,977 | B2 * | 1/2006 | Webber et al. | 482/100 |
| 2006/0293153 | A1 * | 12/2006 | Porth et al. | 482/52 |

* cited by examiner

*Primary Examiner*—Steve R Crow
(74) *Attorney, Agent, or Firm*—Andrus, Sceales, Starke & Sawall, LLP

(57) ABSTRACT

Exercise apparatus has a pair of handles pivotally mounted on a frame and guiding respective user arm motions along swing paths obliquely approaching the sagittal plane of the user.

18 Claims, 13 Drawing Sheets

EXERCISE APPARATUS WITH BIOMECHANICAL ARM MOTION

BACKGROUND AND SUMMARY

The invention relates to exercise apparatus, including exercise movement of the arms of the user in a swinging motion.

Exercise apparatus is known having a frame supporting a user for exercise movement including the arms of the user in a swinging motion forwardly from the sides of the user, e.g. aerobic equipment such as cross-trainers, steppers, elliptical trainers, and other cardiovascular equipment. The present invention arose during continuing development efforts toward improved motion, including a more natural biomechanical motion.

BRIEF DESCRIPTION OF THE DRAWINGS

FIG. 4 is a rear elevation view of the apparatus of. FIG. 1.

DETAILED DESCRIPTION

Figure 1:
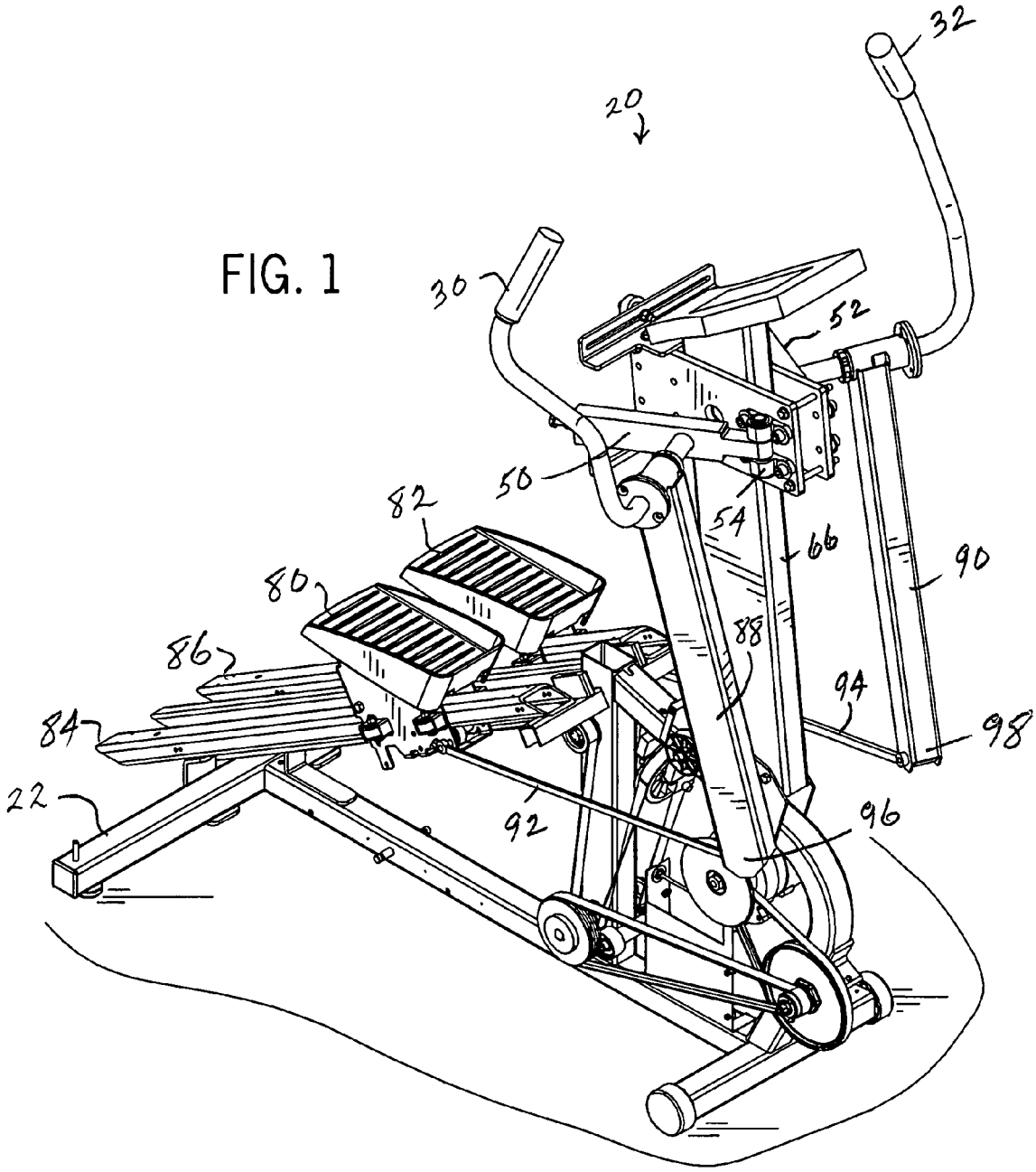
FIG. 1 is a perspective view of exercise apparatus in accordance with the invention.
Figure 2:
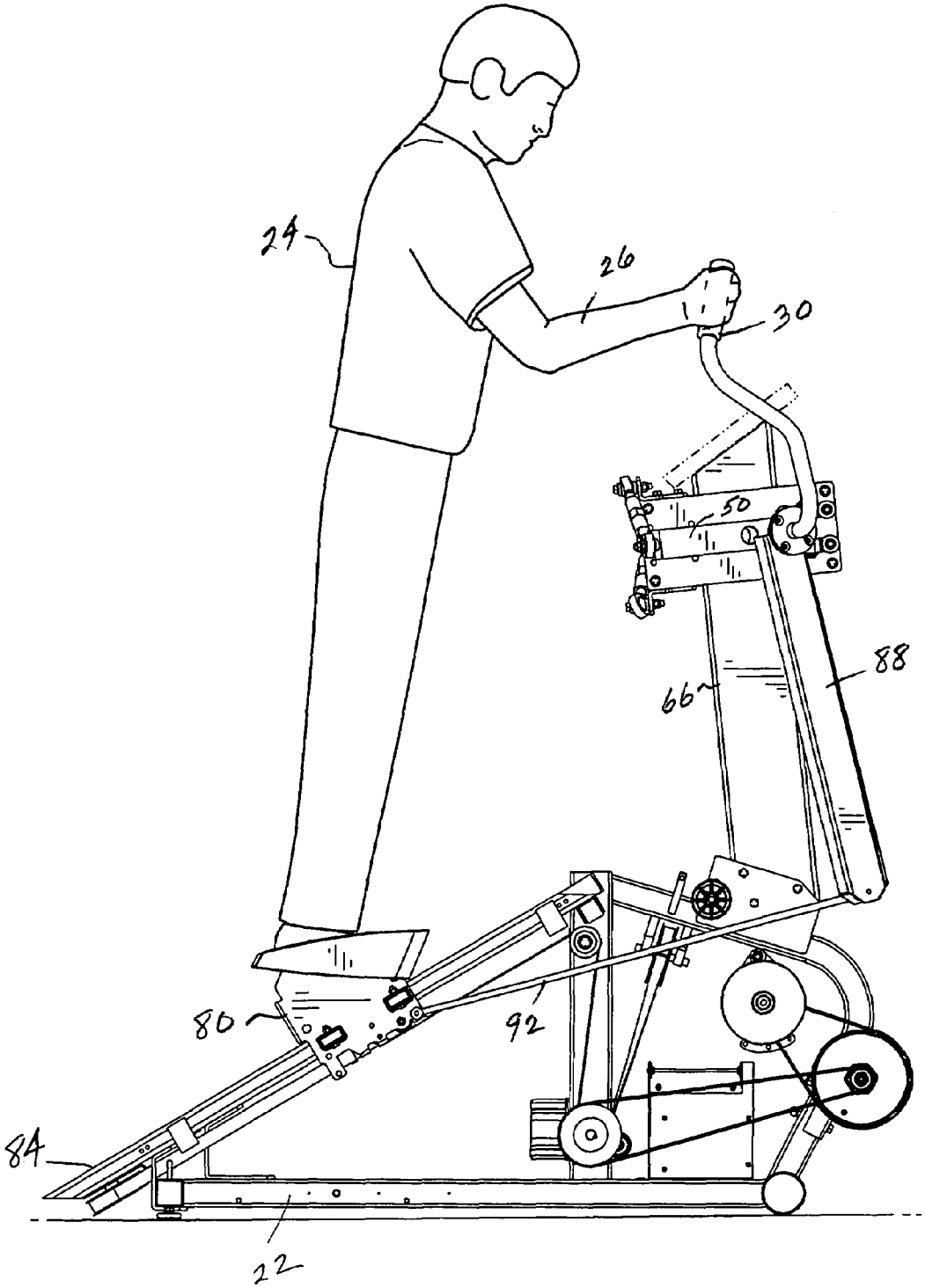
FIG. 2 is a side elevation view of the apparatus of FIG. 1, and showing a user.
Figure 5:
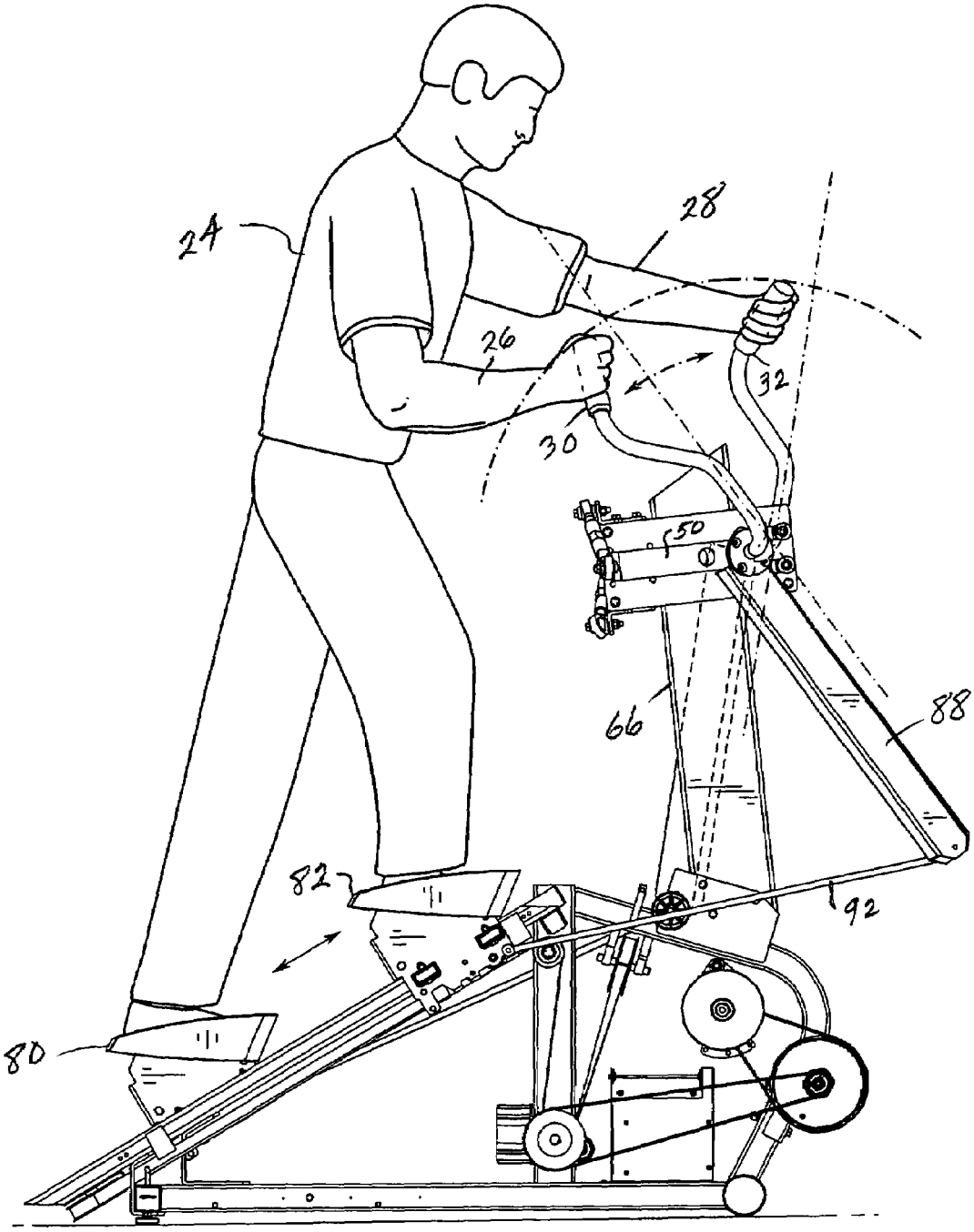
FIG. 5 is like FIG. 2 and illustrates user motion.

FIG. 1 shows exercise apparatus 20 including a frame 22 supporting a user 24, FIG. 2, for exercise movement including the user's arms 26, 28, FIG. 5, in a swinging motion forwardly from the sides of the user. A pair of handles 30 and 32 are movably mounted on the frame and guide each respective arm of the user along a respective swing path 34 and 36, FIG. 7A, obliquely approaching the sagittal plane 38 of the user. Each swing path lies along a respective projection line 40 and 42 obliquely crossing sagittal plane 38 as shown at projection point 44. Projection lines 40 and 42 cross each other as shown at 44 forwardly of the user. Each swing path extends forwardly from the user and angles toward the sagittal plane during forward extension thereof. Each swing path is laterally spaced from sagittal plane 38 by a first lateral distance at the side of the user, and is laterally spaced from sagittal plane 38 by a second lateral distance at a point forward of the user. The noted first lateral distance is greater than the noted second lateral distance.

Figure 3:
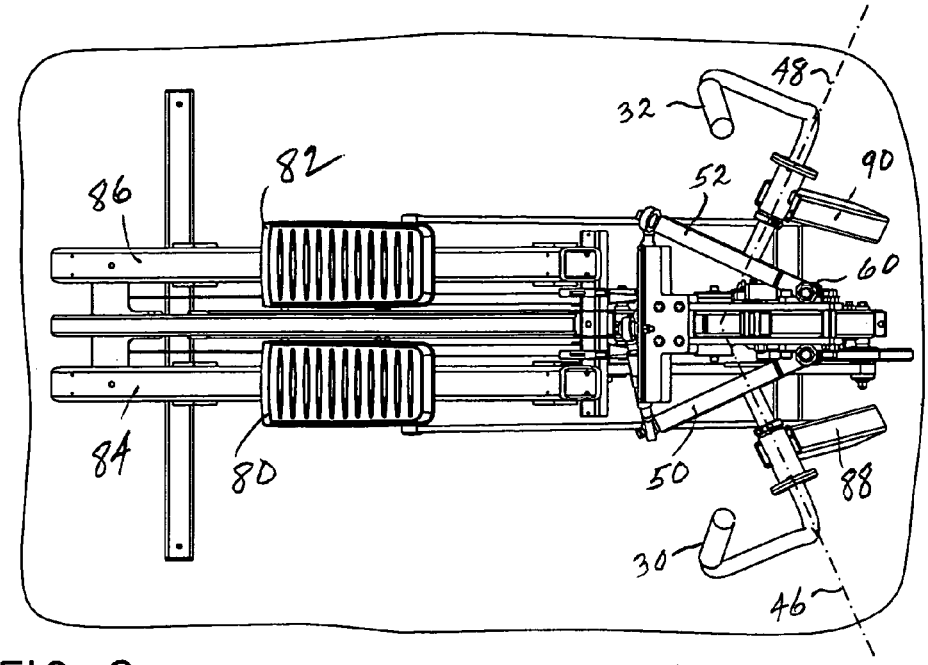
FIG. 3 is a top elevation view of the apparatus of FIG. 1.
Figure 4:
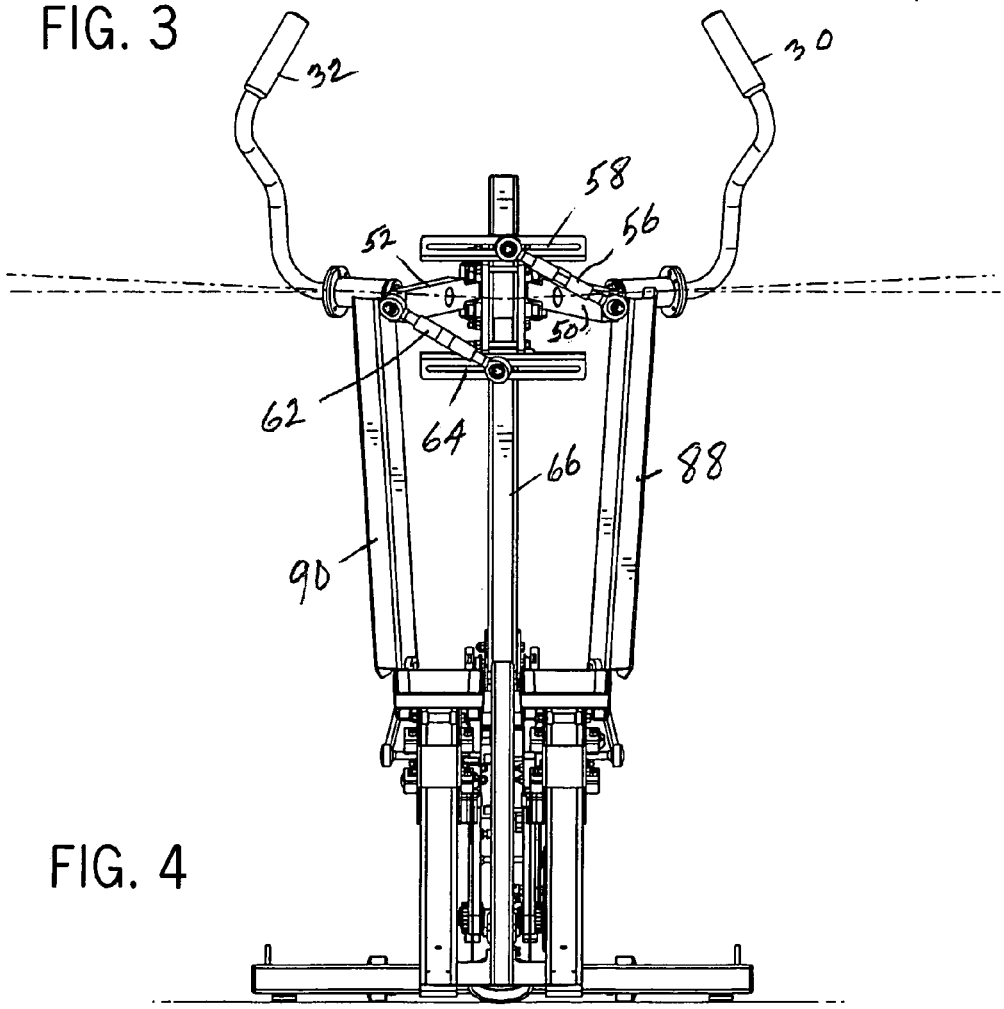
Figure 6:
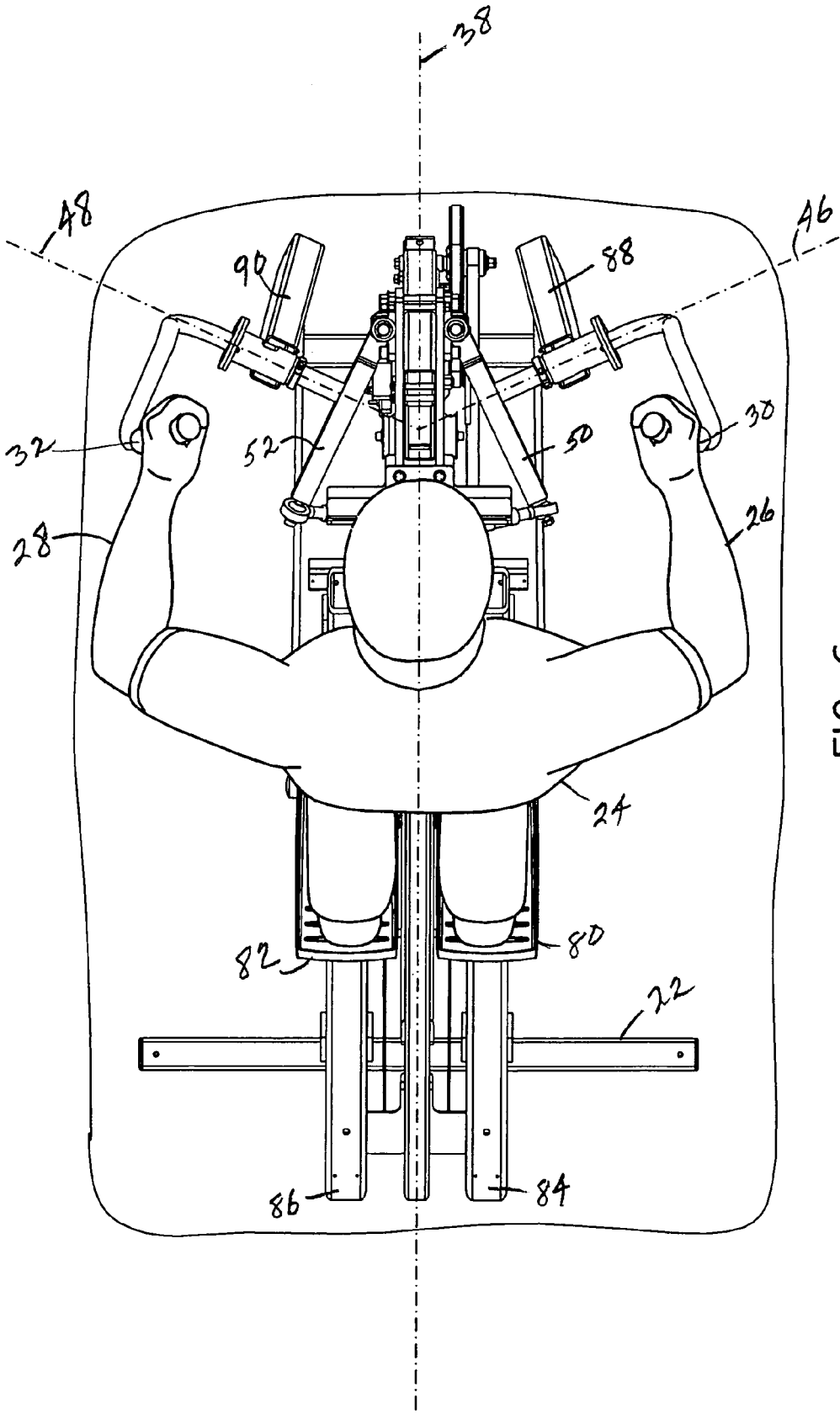
FIG. 6 is like FIG. 3 and illustrates a user position.
Figure 7A:
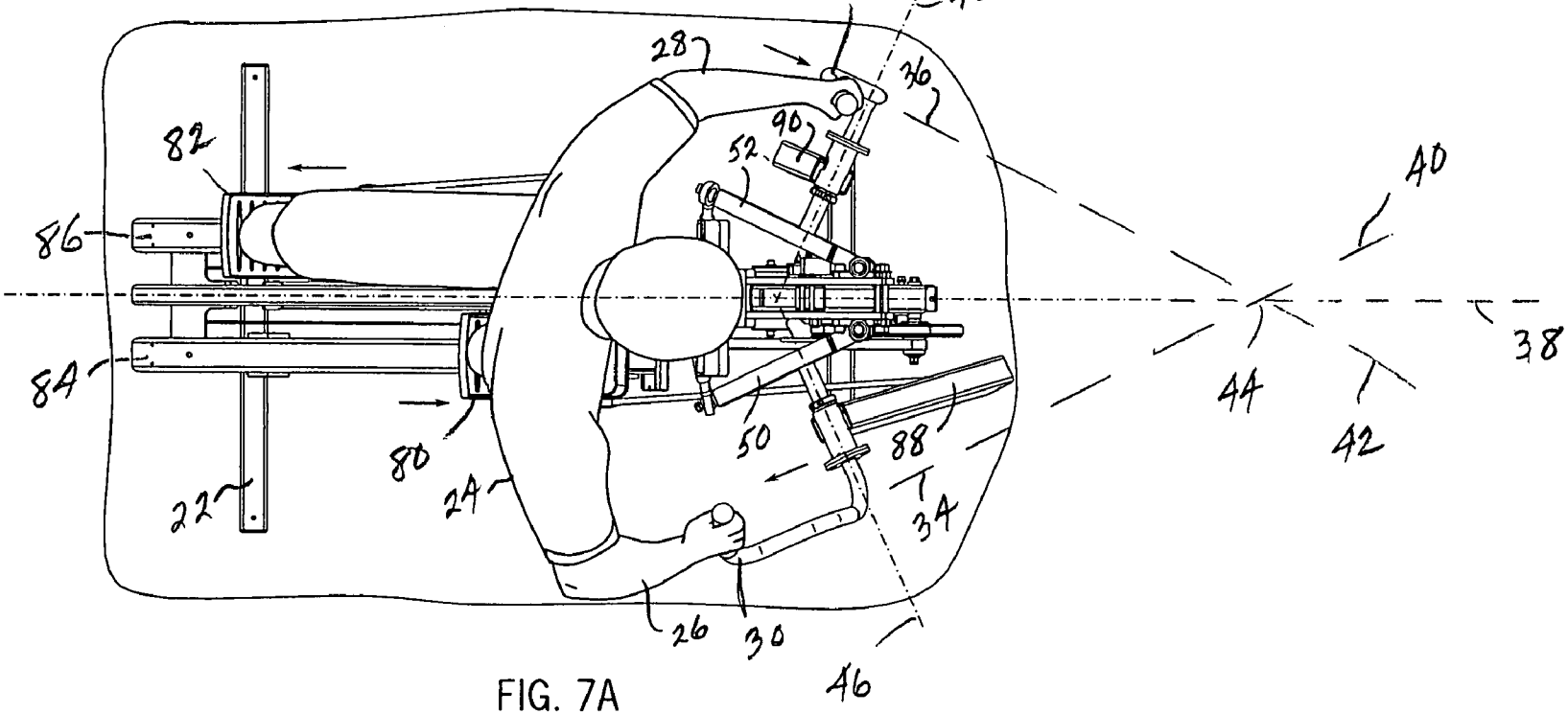
FIG. 7A is like FIG. 6 and shows user motion.
Figure 7B:
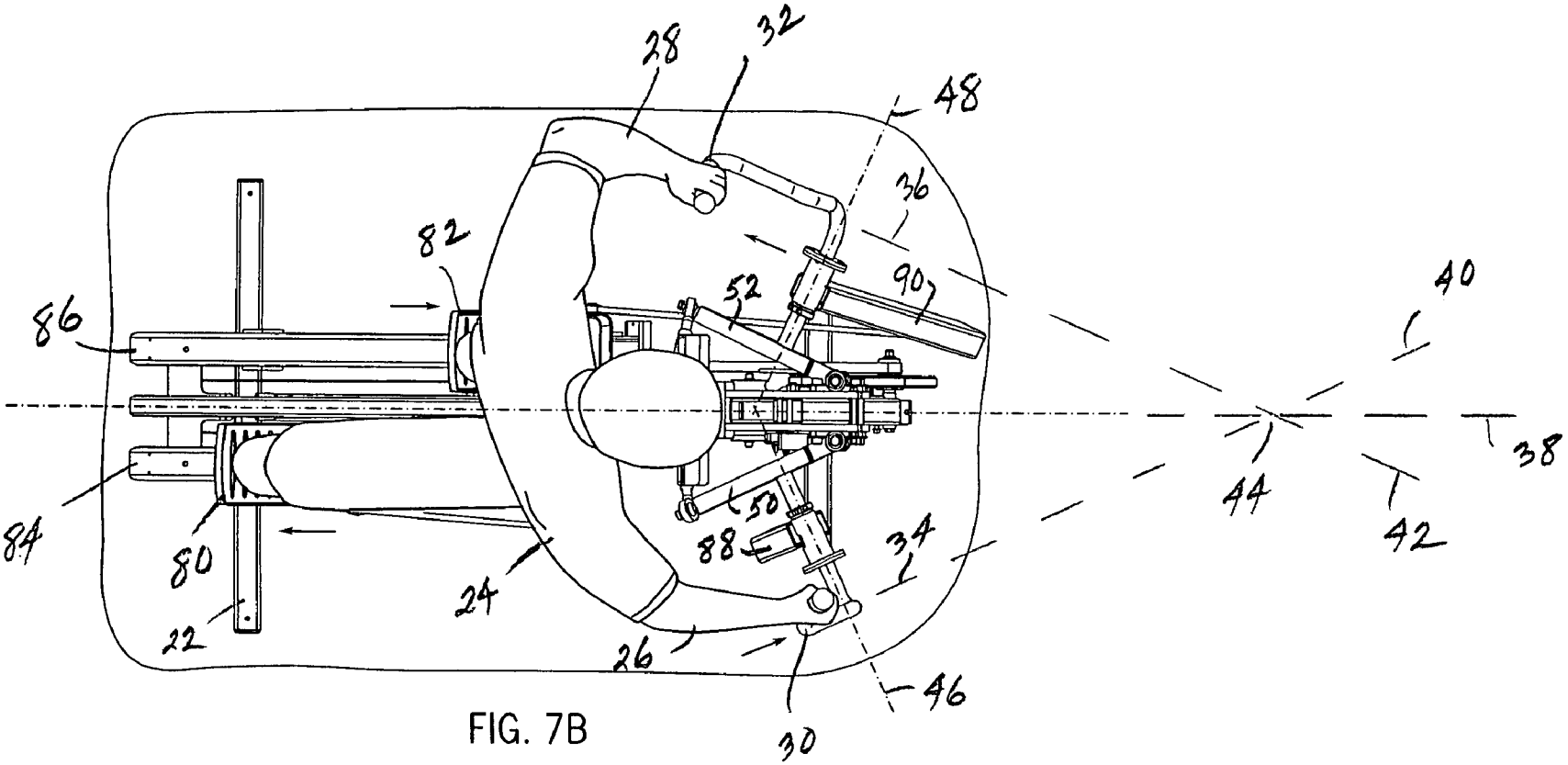
FIG. 7B is like FIG. 6 and shows user motion.
Figure 8:
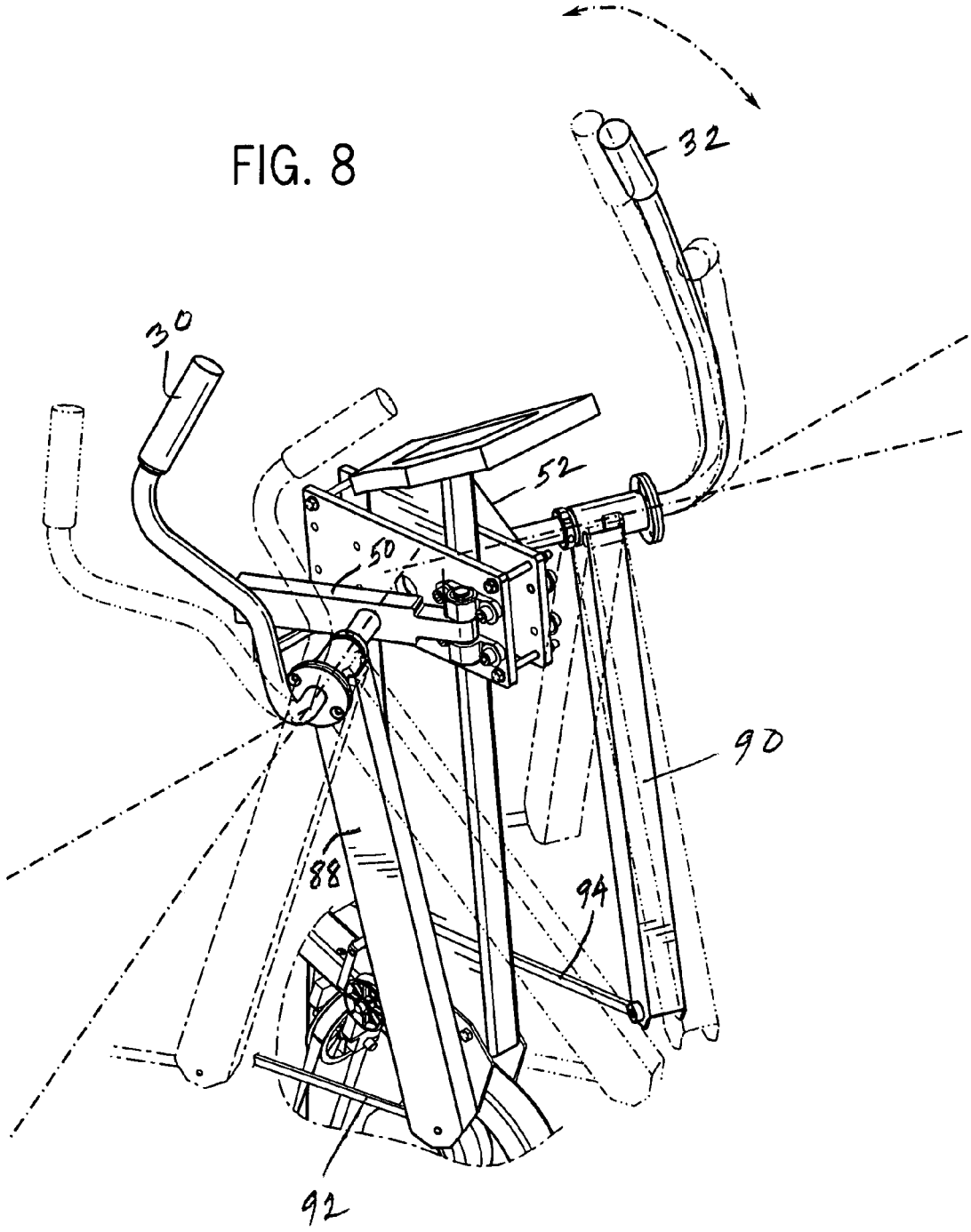
FIG. 8 is a perspective view of a portion of the apparatus of FIG. 1 and illustrates handle motion.
Figure 9:
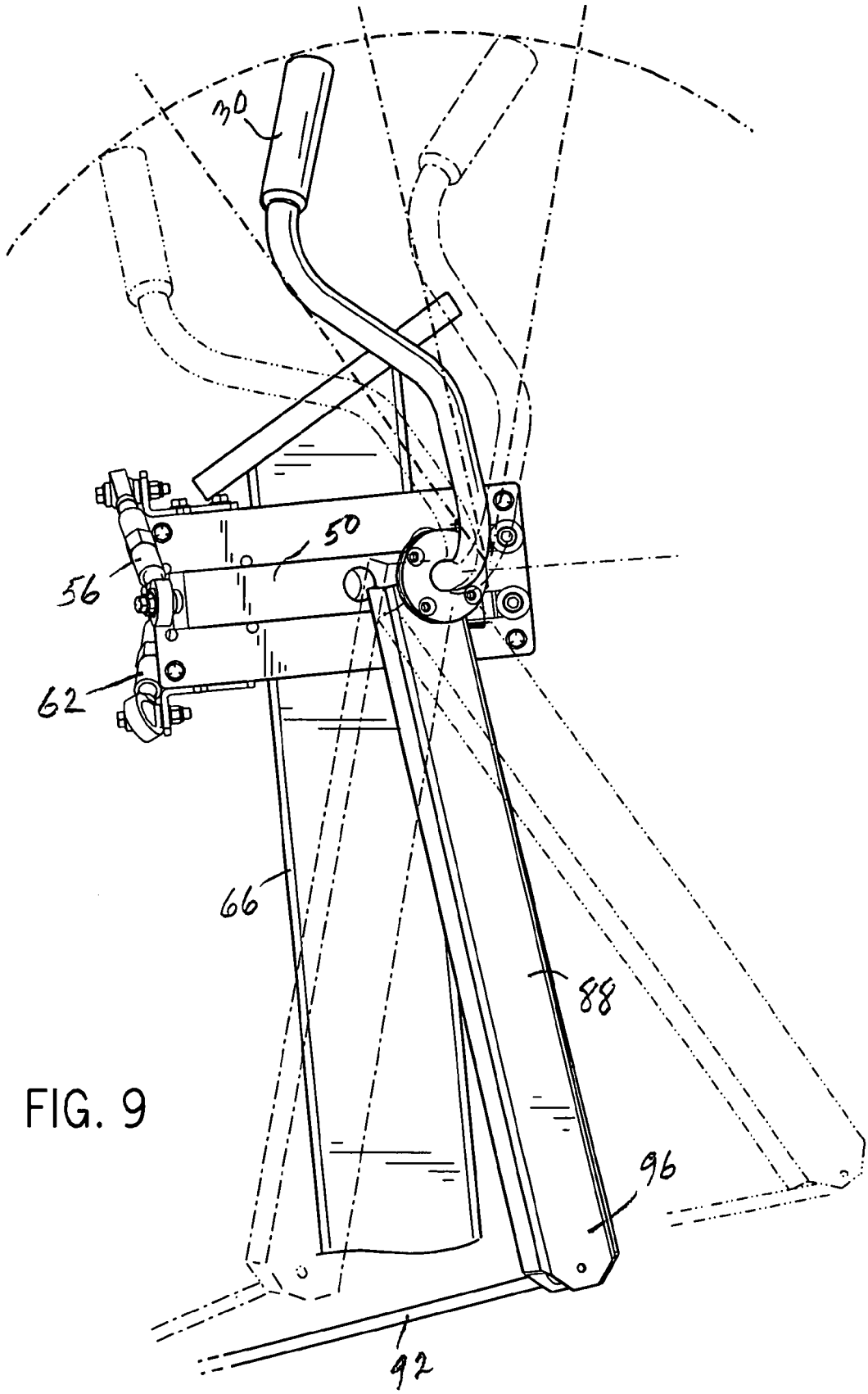
FIG. 9 is a perspective view from another angle of the apparatus of FIG. 8 and illustrates handle motion.
Figure 10:
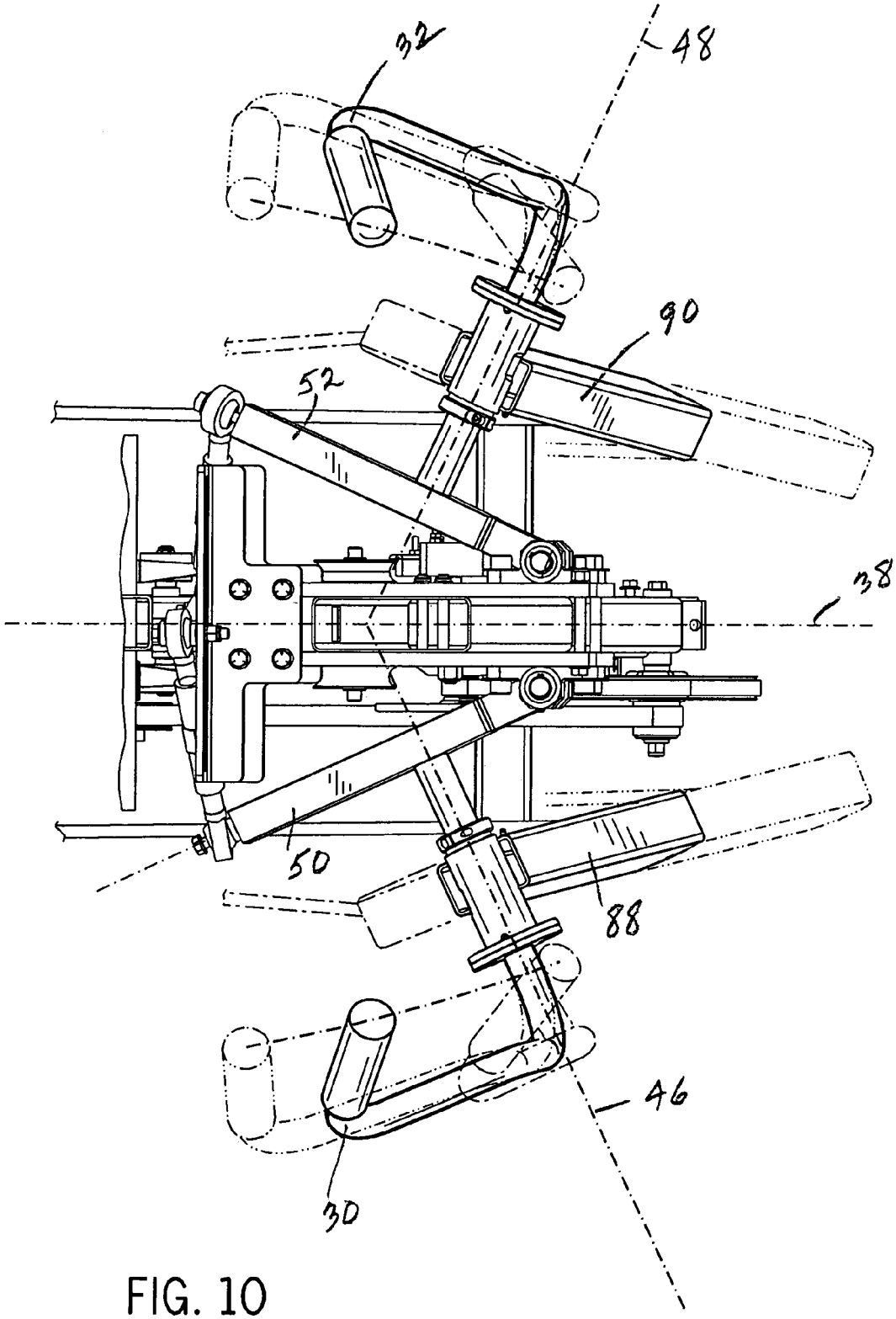
FIG. 10 is a view of a portion of FIG. 3 and illustrates handle motion.
Figure 11:
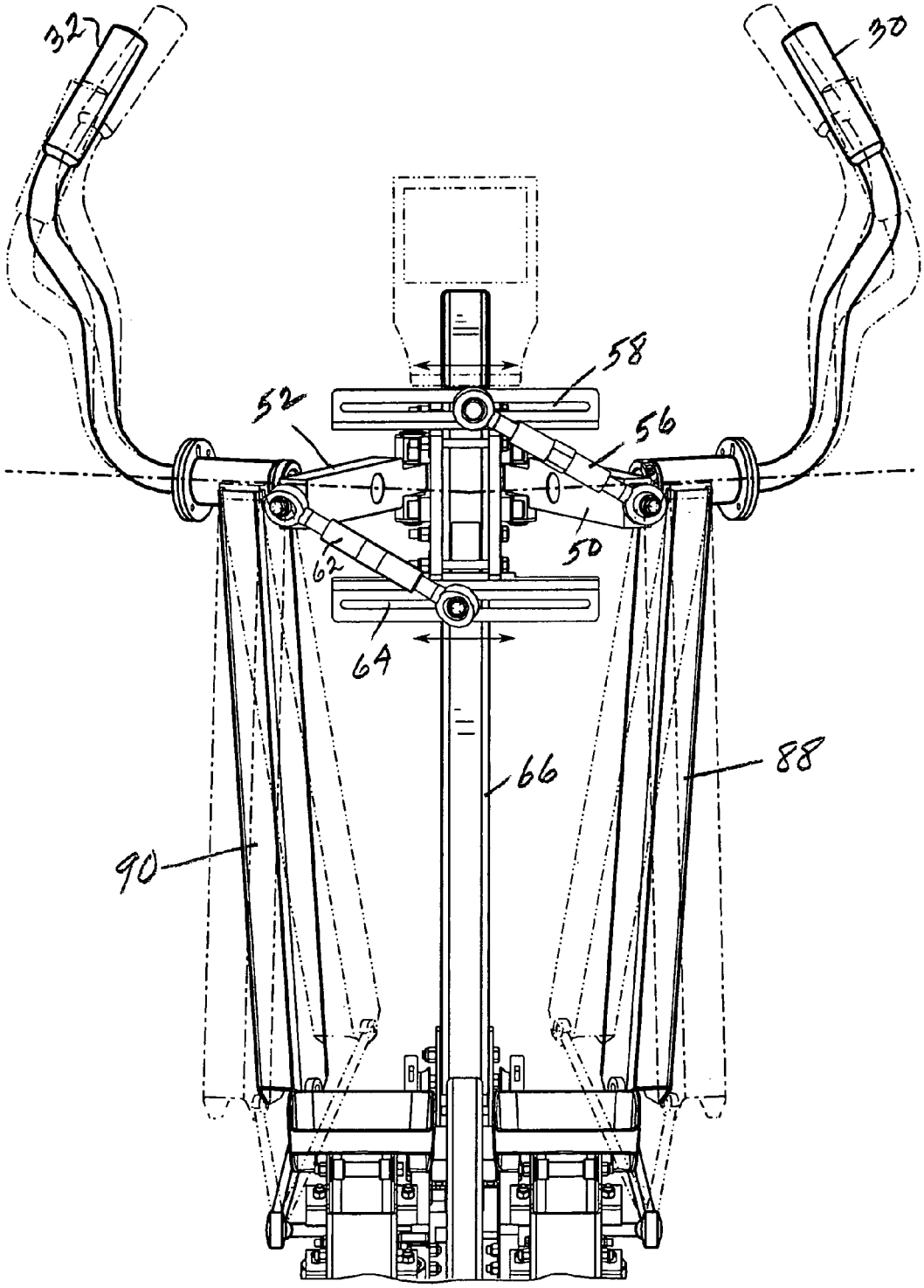
FIG. 11 is a view of a portion of FIG. 4 and illustrates handle motion.
Figure 12:
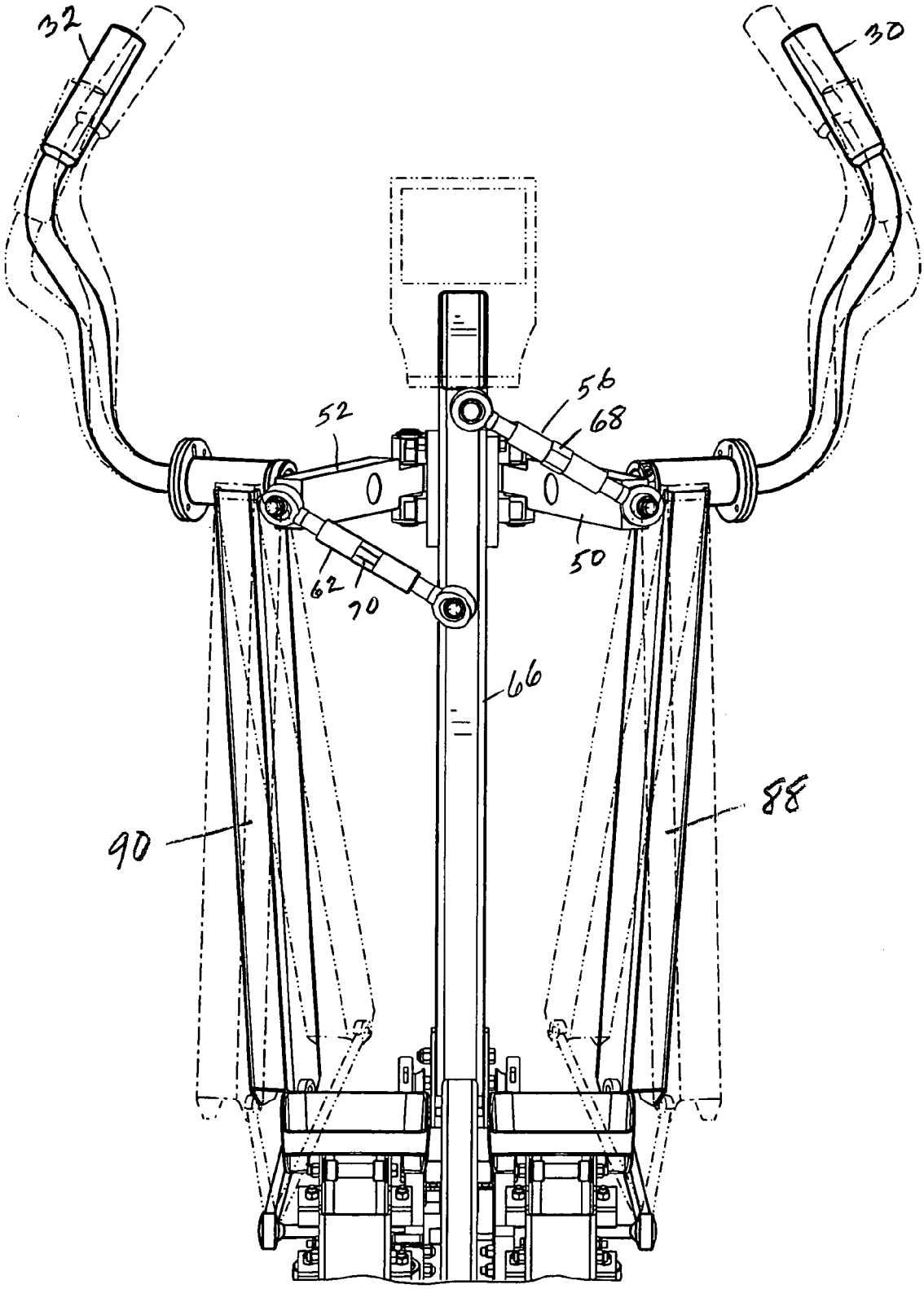
FIG. 12 is like FIG. 11 and shows another embodiment.
Figure 13:
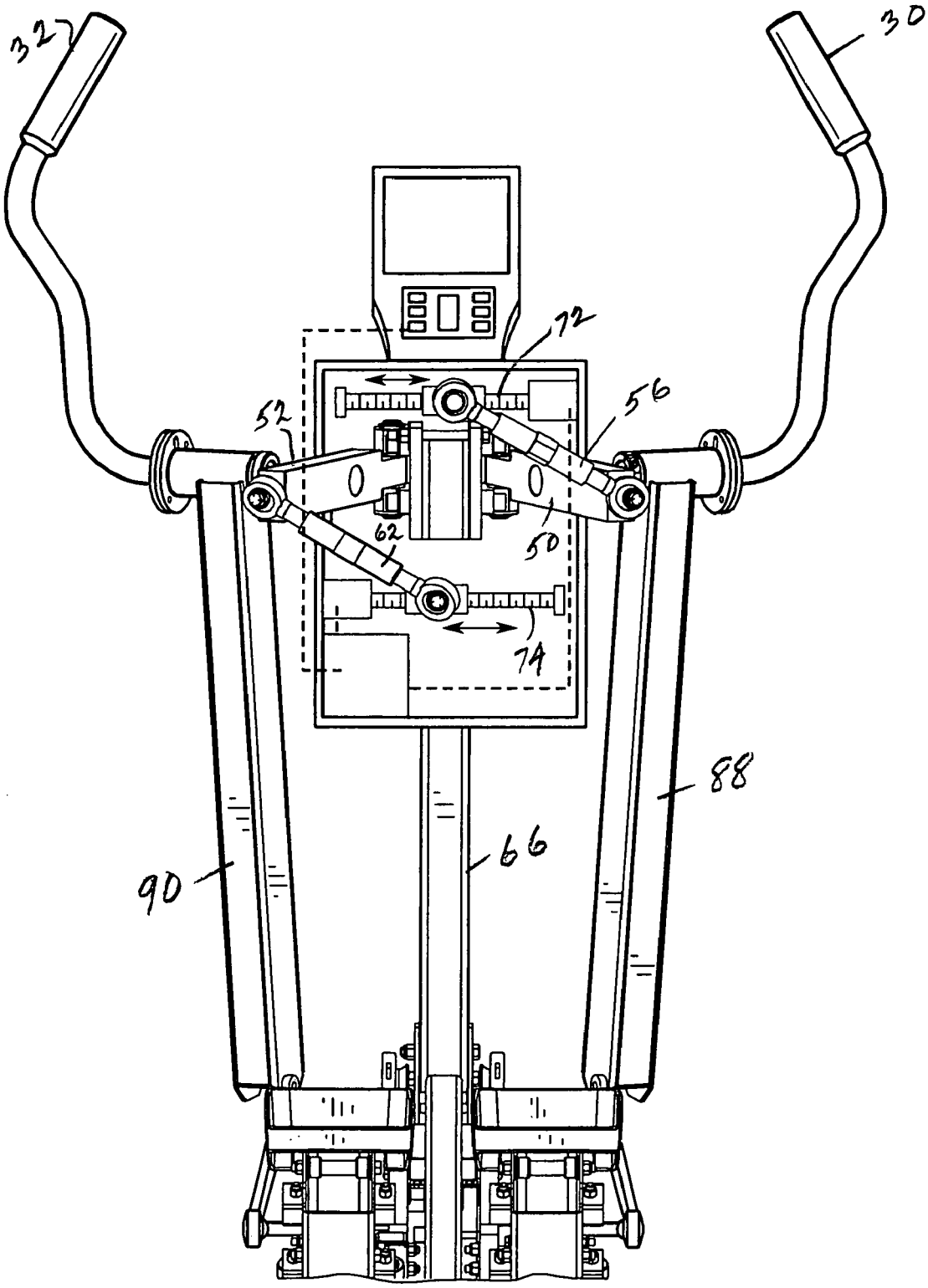
FIG. 13 is like FIG. 11 and shows another embodiment.

In the preferred embodiment, handles 30 and 32 are pivotally mounted to the frame and pivot about respective pivot axes 46 and 48, FIGS. 3, 6, 7A, extending non-perpendicularly to sagittal plane 38. The pivot axes are fixed relative to the frame during user exercise. The pivot axes may be adjustably fixed to the frame such that the angles of the pivot axes relative to the sagittal plane are changeable between exercises by the user. For example, each of the pivot axes is mounted to the frame by a respective variable angle pivot mount 50 and 52, FIGS. 1-8, for varying the angle of the pivot axes relative to sagittal plane 38. Pivot mount 50 has a forward end mounted to the frame at hinge 54, FIG. 1, and has rearward end swingable laterally toward and away from sagittal plane 38 by adjustment link 56, FIGS. 4, 11, sliding along adjustment slot 58. Left pivot mount 52 is comparable and has a forward end mounted to the frame at hinge 60, FIG. 3, and has a rear end swingable laterally toward and away from sagittal plane 38 at adjustment link 62, FIGS. 4, 11, slidable along lateral slot 64. In another embodiment, FIG. 12, the slots 58 and 64 are eliminated, and adjustment links are mounted to center post 66 of the frame and adjustable by knobs or nuts 68, 70 which are loosened to allow telescopic movement of the respective link 56, 62 to in turn laterally move the rear end of the respective pivot mount 50, 52 laterally toward or away from the sagittal plane. In another embodiment, FIG. 13, the ends of the respective links 56, 62 may be mounted on a respective threaded worm drive 72, 74 for adjustment. In another embodiment, each of mounts 50 and 52 is fixed and non-adjustable, to provide fixed non-adjustable respective pivot axes 46, 48.

In the current embodiment, each swing path 34, 36 is arcuate and uniplanar. In further alternatives, the swing paths may have various shapes, including arcuate, curvilinear, compound motion, or various three dimensional curves. For example, various selectable motions can be created with 4 bar mechanisms in the skewed planes 40, 42, as well as various three dimensional curves by substitution of a ball joint in place of the noted pivot mount and pivot axis, with the addition of another path constraining link. In a further alternative, a curved guide rail may be provided to guide a respective handle in addition to or in place of a pivot for guiding the respective handle and arm of the user. The noted pivot axis motion may be desired for simplicity and economy of manufacture, and does replicate the biomechanical arm motion of the user along a swing path obliquely approaching the sagittal plane. The noted alternatives may be used where it is desired to even more closely replicate the biomechanical arm motion of the user including along arcuate, curvilinear swing paths or other three dimensional curves obliquely approaching the sagittal plane.

A pair of foot pedals 80 and 82, FIG. 1, are movably mounted to the frame, e.g. for sliding movement along rails or ramps 84 and 86, and support and guide the feet and legs of the user for exercise movement, FIGS. 2, 5. Handles 30, 32 pivot about respective pivot axes 46, 48 extending non-perpendicularly to sagittal plane 38 and have respective downwardly depending rocker arms 88, 90, FIGS. 1, 8-11, connected by respective links 92, 94 to respective foot pedals 80, 82, such that movement of a respective foot pedal is translated by a respective link and respective rocker arm to pivotal movement of a respective handle along the noted respective oblique swing path 34, 36, FIGS. 7A, 7B, relative to sagittal plane 38. Each rocker arm has a lower portion 96, 98 swinging in an arc about the respective pivot axis 46, 48 oblique to sagittal plane 38. Each link 92, 94 extends forwardly from its respective foot pedal 80, 82 to the lower portion 96, 98 of the respective rocker arm 88, 90. Handles 30, 32 swing in respective arcs about respective pivot axes 46, 48 and in respective arc planes oblique to sagittal plane 38, FIGS. 5, 8-10. The movement of foot pedals 80, 82 may be coordinated and resisted by a pulley and belt system and resistance, as known in the art. Links 92, 94 may be a belt or other type of link.

In the foregoing description, certain terms have been used for brevity, clearness and understanding. No unnecessary limitations are to be implied therefrom beyond the requirement of the prior art because such terms are used for descriptive purposes and are intended to be broadly construed. The different configurations described herein may be used alone or in combination with other configurations. It is to be expected that various equivalents, alternatives and modifications are possible within the scope of the appended claims.

What is claimed is:

1. Exercise apparatus comprising a frame supporting a user for exercise movement including the arms of the user in a swinging motion forwardly from the sides of the user, a pair of handles movably mounted on said frame and guiding each respective arm of the user along a swing path obliquely approaching the sagittal plane of the user, a pair of foot pedals movably mounted to said frame and supporting and guiding the feet and legs of the user for exercise movement, wherein said handles have respective downwardly depending rocker arms connected by respective links to said foot pedals, such that movement of a respective said foot pedal is translated by a respective said link and respective said rocker arm to movement of a respective said handle along said oblique swing path relative to said sagittal plane.

2. The exercise apparatus according to claim 1 wherein each said rocker arm has a lower portion swinging in an arc plane oblique to said sagittal plane, and each said link extends forwardly from the respective said foot pedal to said lower portion of the respective said rocker arm, whereby said handles and said lower portions of said rockers arms swing in respective arc planes oblique to said sagittal plane.

3. The exercise apparatus according to claim 2 wherein said handles pivot about respective pivot axes extending non-perpendicularly to said sagittal plane, and each said lower portion of the respective said rocker arm swings in an arc about the respective said pivot axis.

4. The exercise apparatus according to claim 1 wherein each said swing path lies along a projection line obliquely crossing said sagittal plane.

5. The exercise apparatus according to claim 1 wherein said swing paths lie along respective projection lines crossing each other forwardly of the user.

6. The exercise apparatus according to claim 1 wherein each said swing path extends forwardly from the user and angles toward said sagittal plane during forward extension thereof.

7. The exercise apparatus according to claim 6 wherein each said swing path is laterally spaced from said sagittal plane by a first lateral distance at the side of the user, and each said swing path is laterally spaced from said sagittal plane by a second lateral distance at a point forward of the user, wherein said first lateral distance is greater than said second lateral distance.

8. The exercise apparatus according to claim 7 wherein each said swing path is arcuate.

9. The exercise apparatus according to claim 8 wherein each said swing path is uniplanar.

10. The exercise apparatus according to claim 1 wherein said handles are pivotally mounted on said frame.

11. Exercise apparatus comprising a frame supporting a user for exercise movement including the arms of the user in a swinging motion forwardly from the sides of the user, a pair of handles movably mounted on said frame and guiding each respective arm of the user along a swing path obliquely approaching the sagittal plane of the user, a pair of foot pedals movably mounted to said frame and supporting and guiding the feet and legs of the user for exercise movement, wherein said handles have respective downwardly depending rocker arms connected by respective links to said foot pedals, such that movement of a respective said foot pedal is translated by a respective said link and respective said rocker arm to movement of a respective said handle along said oblique swing path relative to said sagittal plane, wherein said handles are mounted to said frame by a pair of mounts each attaching a respective said handle to said frame, said mounts being adjustably fixed to said frame such that said swing paths relative to said sagittal plane are changeable between exercises by the user.

12. The exercise apparatus according to claim 11 wherein said mounts are variable angle mounts for varying the angle of the respective said swing path relative to said sagittal plane.

13. The exercise apparatus according to claim 11 wherein each said swing path lies along a projection line obliquely crossing said sagittal plane.

14. The exercise apparatus according to claim 11 wherein said swing paths lie along respective projection lines crossing each other forwardly of the user.

15. Exercise apparatus comprising a frame supporting a user for exercise movement including the arms of the user in a swinging motion forwardly from the sides of the user, a pair of handles movably mounted on said frame and guiding each respective arm of the user along a swing path obliquely approaching the sagittal plane of the user, a pair of foot pedals movably mounted to said frame and supporting and guiding the feet and legs of the user for exercise movement, wherein said handles have respective downwardly depending rocker arms connected by respective links to said foot pedals, such that movement of a respective said foot pedal is translated by a respective said link and respective said rocker arm to movement of a respective said handle along said oblique swing path relative to said sagittal plane, wherein said handles pivot about respective pivot axes extending non-perpendicularly to said sagittal plane, said pivot axes being adjustably fixed to said frame such that the angles of said pivot axes relative to said sagittal plane are changeable between exercises by the user.

16. The exercise apparatus according to claim 15 wherein each of said pivot axes is mounted to said frame by a variable angle pivot mount for varying the angle of the respective said pivot axis relative to said sagittal plane.

17. The exercise apparatus according to claim 15 wherein each said swing path lies along a projection line obliquely crossing said sagittal plane.

18. The exercise apparatus according to claim 15 wherein said swing paths lie along respective projection lines crossing each other forwardly of the user.

* * * * *